United States Patent [19]

Kagan

[11] Patent Number: 4,669,693

[45] Date of Patent: Jun. 2, 1987

[54] RECEPTACLE SUSPENSION MEANS

[76] Inventor: Michael Kagan, 116 Viceroy Road, Bldg. B Unit #9, Concord, Ontario, Canada

[21] Appl. No.: 634,551

[22] Filed: Jul. 26, 1984

[51] Int. Cl.[4] ..... A47H 1/10

[52] U.S. Cl. ..... 248/318; 47/67

[58] Field of Search ..... 248/154, 318, 27.8; 294/74, 32, 67 E, 67 EA, 67 R, 67 B; 211/113, 119; 47/67

[56] References Cited

U.S. PATENT DOCUMENTS

| | | | |
|---|---|---|---|
| D. 247,400 | 3/1978 | Foster | 47/67 X |
| 1,756,461 | 4/1930 | Hanson | 47/67 |
| 1,834,902 | 12/1931 | Payzant | 294/74 X |
| 3,249,329 | 5/1966 | Currier | 248/154 X |
| 3,854,242 | 12/1974 | Gladstein | 248/318 X |
| 3,981,099 | 9/1976 | Dziewulski | 47/67 |
| 3,988,810 | 11/1976 | Emery | 24/128 R |
| 4,198,020 | 4/1980 | Walker | 248/154 |
| 4,506,475 | 3/1985 | Elliott | 47/67 |
| 4,529,240 | 7/1985 | Engel | 294/74 X |

*Primary Examiner*—J. Franklin Foss

*Attorney, Agent, or Firm*—Ivor M. Hughes

[57] ABSTRACT

For use to support a receptacle, planter or other item having an upper rim and bottom; means for supporting the receptacle, planter or other item are provided comprising a base, a plurality of strands of material, each strand passing through at least two apertures in the base at least one end of which extends to a support, each strand carrying a hook or other inert or non-effacing connector for seating over the rim of the receptacle.

20 Claims, 12 Drawing Figures

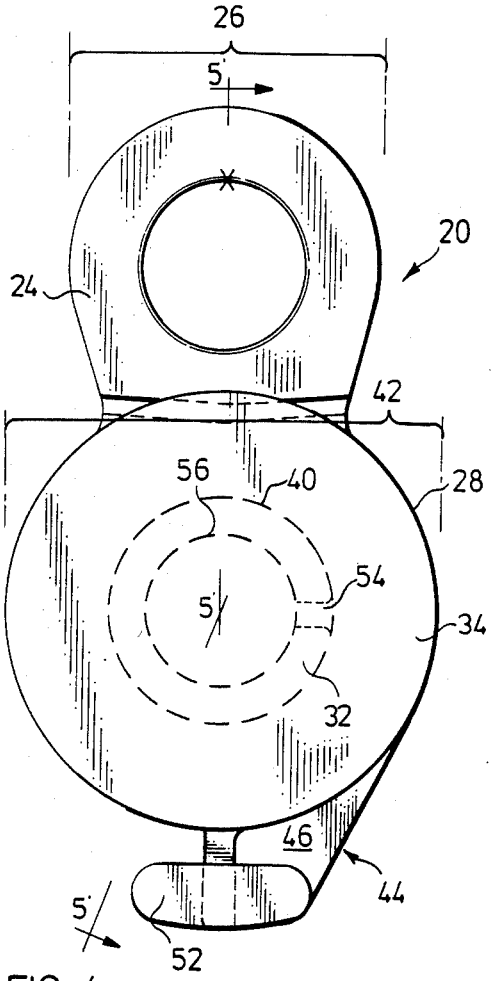
FIG. 4.
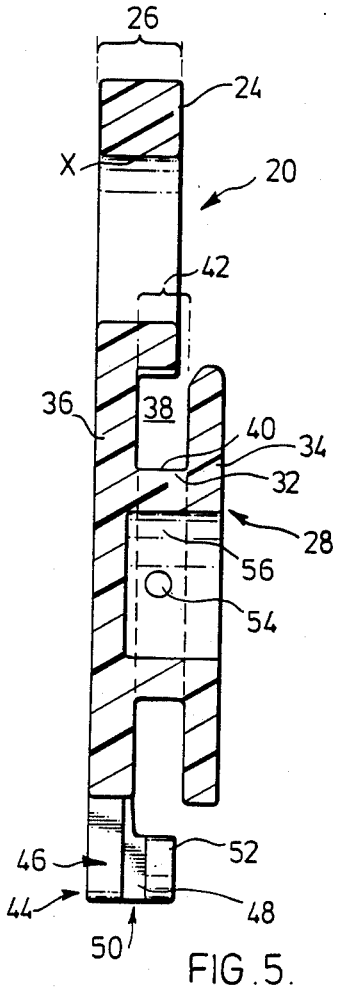
FIG. 5.
FIG. 6.
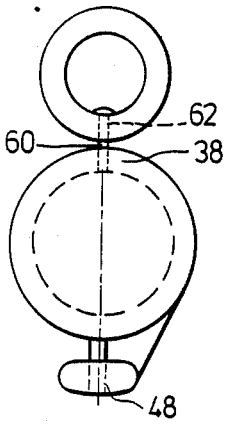
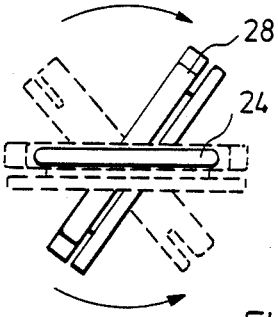
FIG. 7.

FIG. 8.
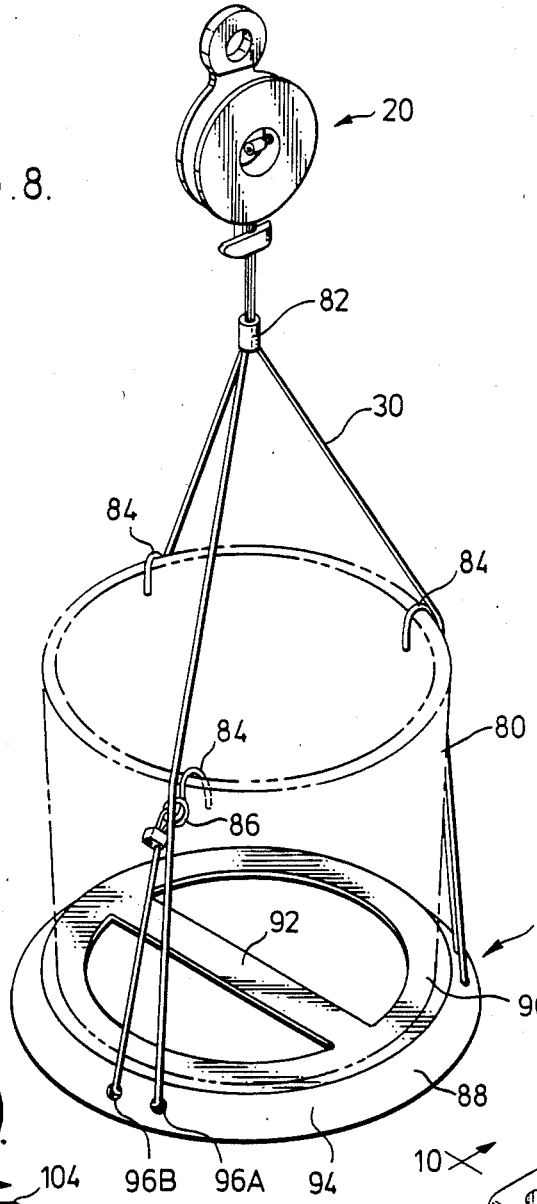
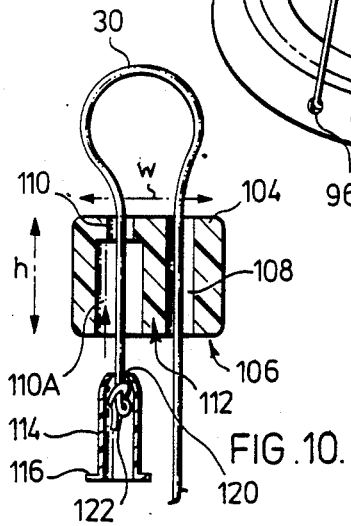
FIG. 10.
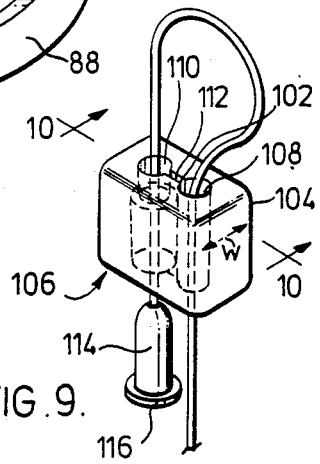
FIG. 9.

RECEPTACLE SUSPENSION MEANS

FIELD OF INVENTION

This invention relates to components suitable for use and reuse to hang receptacles, for example, planters.

BACKGROUND OF INVENTION

Many approaches have been taken to the hanging of planters. They have been secured by macrame, ropes, chains and the like and suspended from hooks fastened to the ceiling.

These approaches, however, each have the disadvantage that their distance from the ceiling cannot be easily adjusted. In most instances the material is knotted to provide some degree of adjustment. However the degree of adjustment is approximate. Additionally, the adjustment is unsightly.

It is therefore an object of this invention to provide components suitable for use to hang planters.

It is a further object of this invention to provide components to hang planters which permit easy adjustment of the distance the planter is suspended from the support (for example, the ceiling).

It is a further object of this invention to provide for such adjustment without special tools, or complex or unsightly adjustments.

In many instances, it is desired to suspend planters without any apertures, slots or slits in their body. In those instances, the means of suspending the planter must safely and attractively envelope the planter in such a way to permit secure suspension. Therefore, the means for suspension must carry a seat substantially of the same size as the bottom or base of the planter with the sides of the means of suspension engaging the sides of the planter to securely and attractively hold the planter. If the means of suspension is not the right size the planter will not be securely and/or attractively suspended.

It is therefore an object of this invention to provide an improved means for suspending a planter which does not require the use of holes, slits, slots, tabs or protrusions or other means of modifying the planter to securely yet attractively suspend the planter.

Further and other objects of the invention will be realized by those skilled in the art from the following summary of the invention and detailed description of the preferred embodiments thereof.

SUMMARY OF INVENTION

According to one aspect of the invention, a "hanger support" suitable for use in hanging a receptacle (for example, a planter) or other items (such as signage) is provided, the support comprising:

(1) a hanger from which the support may be secured to hang a receptacle (planter), or other item from, for example, a hook in the ceiling, the hanger having:

(a) a plane or zone disposed or oriented in the vertical direction when the "hanger support" is secured or suspended for hanging for example, a planter, and, (b) a position whereat the hanger would be supported when the support is used to hang a planter, (2) a take-up reel having an endless channel defined between a pair of preferably radially extending walls extending from either end of the reel, the take-up reel secured to the hanger for taking up material (for example, cables for example nylon-coated kink-resistant stainless steel cable, wire, plastic strands, or the like) for supporting the planter or other item, the take-up reel incorporating a plane or zone disposed in the vertical direction when the "hanger support" is secured or suspended for hanging the planter, or other item, and (3) a lock vertically below the reel and hanger offset to the plane or zone of the take-up reel but in vertical alignment with the plane or zone of the hanger, to cause material extending downwardly from the reel to be offset relative to the plane or zone of the reel and into the vertical plane or zone of the hanger and in vertical alignment with the position in the hanger whereat the hanger would be supported to support the "hanger support" whereby there exists neither rotational forces exerted about the hanger causing the reel to rotate about the hanger nor forces tending to cause the reel to tilt out of a vertical plane or zone.

In this way, excess material carried in the "hanger support" may be wound-up and stored to permit alteration of the vertical position of the receptacle (for example, planter) or reuse with another receptacle as required. Furthermore, this support lends itself to use with small diameter cables and support means which facilitate the display of planters and plants contained therein without visual conflict with the means of suspension. This "hanger support" structure also finds use to hang other items for display purposes which require length adjustment, such as signage.

In one embodiment the lock incorporates a vertically extending slot (when the support is hung) offset to the plane or zone of the take-up reel and vertically aligned with the plane or zone of the hanger, to assist to lock the material to extend vertically offset from the plane or zone of the take-up reel.

In another embodiment, the lock comprises an L-shaped structure extending below the take-up reel, the L-shaped structure comprising a pair of spaced flanges extending laterally from the structure (preferably at the bottom thereof), the L-shaped structure carrying a slot between the spaced flange offset relative to the plane or zone of the take-up reel but aligned with the plane or zone of the hanger to permit material from the reel to pass through the slot and be locked thereby to hang vertically therefrom.

According to another aspect of the invention, the take-up reel is rotatable about a vertical axis relative to the hanger. In one embodiment, the take-up reel is rigidly fixed relative to the lock so that the lock, and, in the embodiment where the lock incorporates the slot, the slot, are each offset relative to the zone or plane of the take-up reel but in vertical alignment with the plane or zone of the hanger.

According to another aspect of the invention, the take-up reel may carry an aperture through the reel surface around which the material is wound to permit material passed through the aperture to be tied, knotted and/or covered by a brass fitting (eyelet) and/or, crimped to secure the material behind the surface. Therefore, where the length of the material is to be adjusted (shortened for example), more material can be pulled through the aperture and for example, tied or knotted behind the aperture to preclude the pulled through material from returning to the take-up reel until for example, the knot is untied. Where the take-up reel is rotatable about a vertical axis relative to the hanger, a pin may be fixed in one of the radially extending walls of the take-up reel and passed through a portion of the hanger permitting relative rotation of the pin and thus the take-up reel relative to the hanger. A cap may be used to cover the pin to secure the pin to the hanger.

The support may be used to carry material (for example, nylon covered kink-resistant stainless steel cable) used to secure and suspend a planter in the manner disclosed in my Canadian Application Serial Number 372,031 and in U.S. patent application Ser. No. 126,663 in which Applications a receptacle or container (e.g. a planter) having an outer surface and bowl shaped recess is provided for carrying a plurality of tabulate bodies or protrusions equally spaced about the planter, each tabulate body or protrusion presenting a face on the side of the body remote the outer surface of the planter and being carried by the planter proximate its rim, each tabulate body or protrusion carrying a slot intermediate its width from proximate the top of the protrusion extending downwardly and opening through the bottom and the face of the protrusion, the slot opening through the face being less than the width of the slot, the slot carrying a socket or wider slot portion at the upper end of the slot in communication with the slot, also opening through the face, the opening through the face being less than the width of the socket, the tabulate body or protrusion carrying another channel, slot or groove from the bottom of the protrusion, preferably also curvilinearly around a peripheral or circumferential portion of the protrusion, to the upper rim portion and having means for restricting a portion of the opening of the slot, channel or groove to require flexure of a filament or strand when pushed into the channel, slot or groove to thereby allow the strand to seat and be held in the channel, slot or groove during use in supporting the receptacle.

The material carried by the reel may comprise nylon covered kink-resistant steel wire or extruded monofilaments (stranded, twisted or braided) or any other suitable material found on the market, each strand or length of material carrying a knot, button, fitting, rivet or the like (of a width greater than the width of the slot) for being received longitudinally into each socket and locked against removal through the face of the body by the wider dimensions of the knot, fitting, rivet or the like than the restricted slot opening through the face, the wire or thread causing the means for restricting the channel, slot or groove to flex when pushed into the channel, slot or groove until sufficient force is exerted to remove the wire or thread past the means.

According to another aspect of the invention, where the planter is unmodified but comprises an upper planter rim and bottom, means for supporting the planter or any receptacle or item are provided comprising a base, a plurality of strands of material, each strand passing through at least two apertures in the base to a support, each strand carrying a inert connector (for example, a clip) for seating over the rim of for example the planter. The connector, in one embodiment, carries a depending loop to which one end of the strand is secured and through which loop the strand of material passes to the support used for suspending the receptacle. Preferably the base comprises a horizontally extending support portion and an annular skirt secured to the outer periphery of the horizontally extending support portion sloped angularly outwardly and downwardly away from the horizontally extending support portion and the apertures are disposed in the skirt.

Where the means for supporting for example, the planter comprises at least three strands of material, the base comprises at least three pairs of equally spaced apertures in the base, one pair for each strand, each pair of apertures being spaced from one another and preferably by a curved spacer surface on the side of the base remote the top of the base supporting the planter, for carrying one strand of material between the apertures to prevent extreme bends in the strand material to prevent weakening of the line, each strand being secured to a inert or non-effacing connector, preferably to a loop at one end of the inert or non-effacing connector with an intermediate portion of the strand material also passing through the loop, intermediate the strand's length, the other end of the strand to which the intermediate portion is secured being secured to a support to support for example, the planter.

For locking the end of the strand with the connector on it, an injection molded component having an upper end and a lower end, may be employed comprising a slot extending through the body of the component between the upper and lower ends, the slot having a width, height and varying depths with the side edges of the slot being of a greater depth than the central portion, the deeper slot portion on one side extending through the body from the upper end to lower and the other deeper slot portion having an enlarged slot portion extending from intermediate the upper and lower ends to either the upper and lower ends to form a socket. With this component, the strand of material which carries the connector, may be locked by this component to the connector, the strand of a width to pass through the wider slot portion at each side edge of the slot but not the central reduced slot portion, the enlarged slot portion forming the socket to accommodate a fitting, button, knot, rivet or the like at the end of the strand.

Where the means for supporting the planter, receptacle or other item comprises only two strands (or a plurality of strands joined together to form two strands of material) the base comprises:

(i) a pair of a two spaced apertures in the base, well spaced from one another and, (ii) a pair of other apertures, one of these apertures intermediate each pair of the two spaced apertures in the base, each strand of material having two ends and carrying a loop of material comprised of portions of the strand of material extending through the intermediate aperture from each of the other apertures, the loop carrying a connector, each end of the loop extending through the intermediate aperture to a position behind the base to the aperture of the pair of apertures remote from the portion of the loop between the connector and intermediate aperture, the material passing through the said aperture and through the base to the support for supporting the base, the connector for attaching to the rim to the receptacle carried on the base and the ends of the material for securing the receptacle as supported by the base, to a support for suspending the structure. It is understood throughout the Summary of the Invention that the connector may be a hook or other alternative fastener which securely fastens the resilient member to the rim of the receptacle being supported.

BRIEF DESCRIPTION OF THE DRAWINGS

The invention will now be illustrated with reference to the following description of embodiments of the invention in which:

FIG. 4 is a front view of the "hanger support" of FIG. 1.

FIG. 5 is a cross-sectional view taken along the line 5'—5' of FIG. 4.

FIG. 6 is a front schematic view of a "hanger support" according to another embodiment of the invention.

FIG. 7 is a top schematic view of the "hanger support" in FIG. 6 with part thereof being rotated about a vertical axis relative to the bottom portion.

FIG. 8 is a perspective view of a "hanger support" used to support a planter according to another embodiment of the invention.

FIG. 9 is a close-up view of part of the structure shown in FIG. 8.

FIG. 10 is a cross-sectional view taken along the line 10—10 of FIG. 9.

DETAILED DESCRIPTION OF THE DRAWINGS

Figure 1:
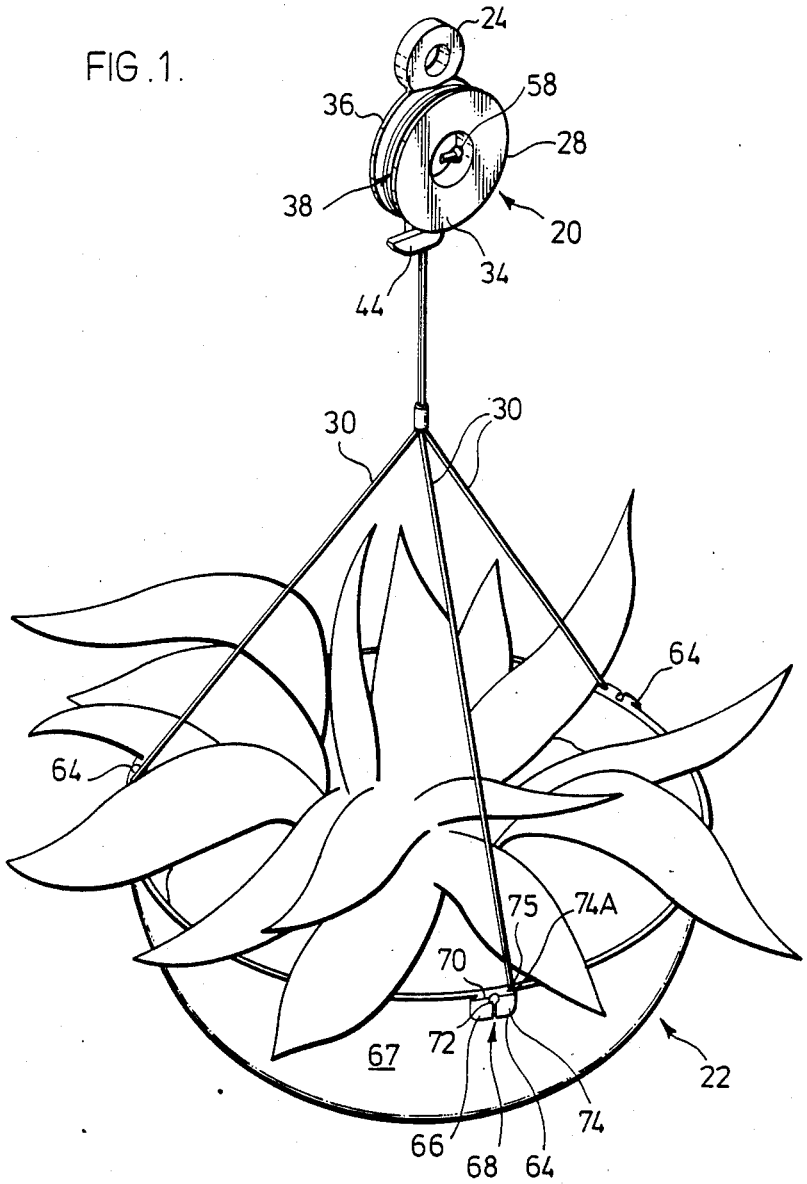
FIG. 1 is a perspective view of a "hanger support" used to carry a receptacle (planter) according to one embodiment of the invention.
Figure 2:
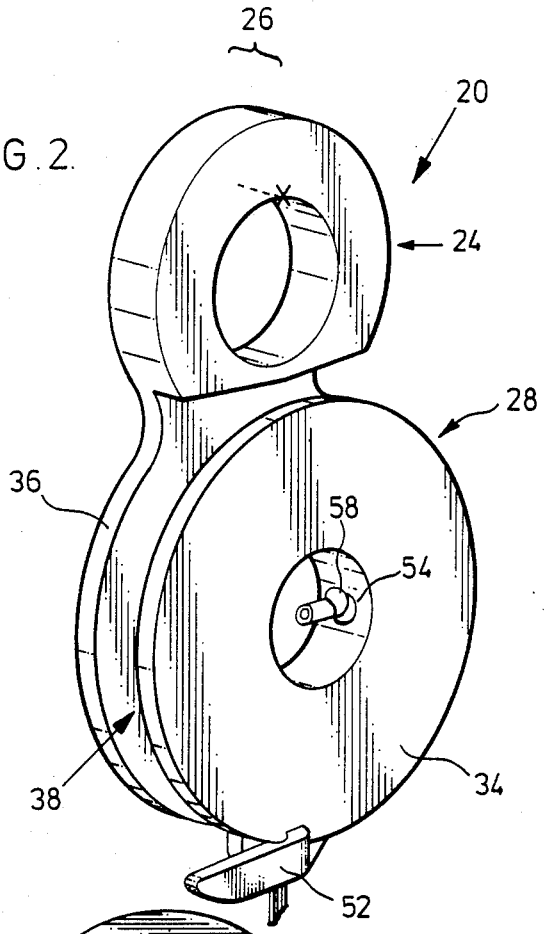
FIG. 2 is a perspective view of the "hanger support" of FIG. 1 looking from one side.
Figure 3:
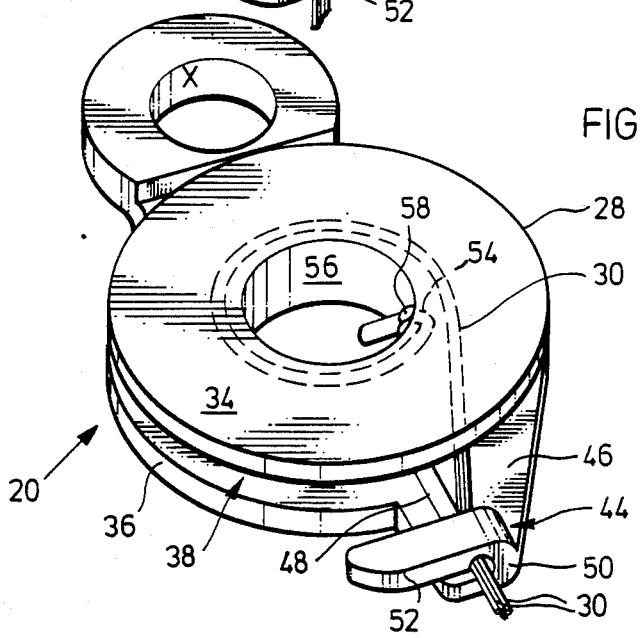
FIG. 3 is a perspective view of the "hanger support" of FIG. 1 looking from the bottom towards the top.
Figure 11:
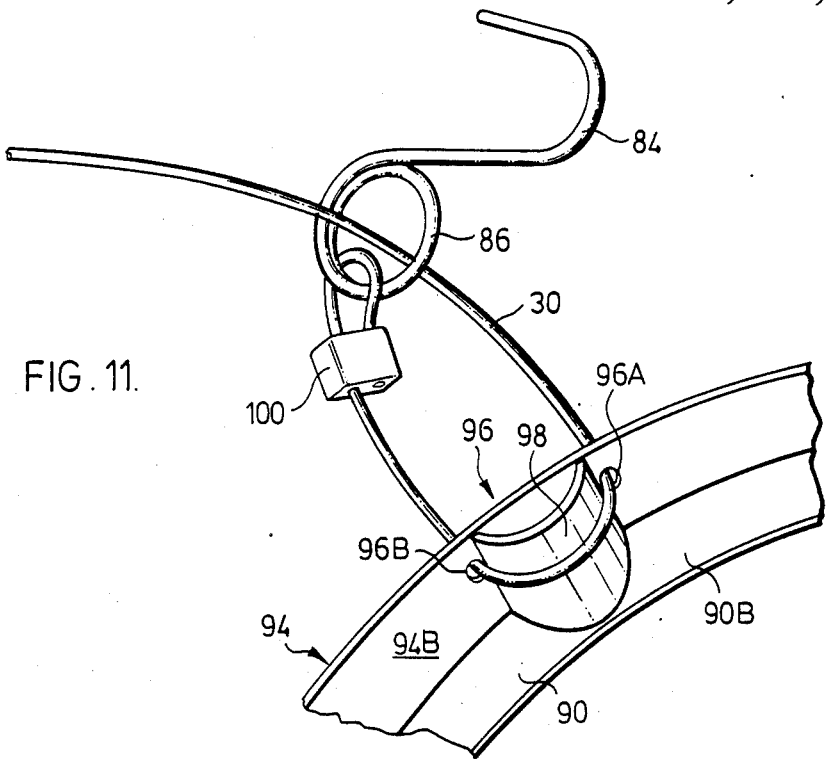
FIG. 11 is a close-up view of part of the structure shown in FIG. 8 in a different position.

With reference to FIGS. 1 to 5 inclusive, "hanger support" 20 is provided suitable for use in hanging a planter 22, support 20 comprising:

(1) hanger 24 having a plane or zone 26 disposed or oriented in the vertical direction (see FIGS. 2 and 4) when "hanger support" 20 is secured or suspended for hanging planter 22 at point X whereat hanger 24 engages a support (for example a hook fastened to the ceiling).

(2) take-up reel 28 integrally injection molded of polycarbonate with hanger 24 for taking up three nylon coated kink-resistant stainless steel lines 30 wrapped around collar 32 (see FIGS. 4 and 5) the sides of which are closed by walls 34 and 36 which extend radially from collar 32 to define endless line receiving channel 38 between the outer peripheral surface 40 of collar 32 and between walls 34 and 36, channel 38 of take-up reel 28 incorporating a plane or zone 42 (see FIGS. 4 and 5) disposed or oriented in the vertical direction when hanger 24 is secured or suspended for hanging planter 22, and, (3) L-shaped locking structure 44 integrally molded with take-up reel 28, offset to plane or zone 42 of take-up reel 28 but in vertical alignment with plane or zone 26 of hanger 24 and particularly the vertical plane passing through point X whereat hanger 24 engages a support (for example a hook fastened to the ceiling) not shown.

L-shaped structure 44 comprises connector 46 formed as an extension of wall 36 and includes channel, slot or groove 48 (formed in the face of connector 46) vertically aligned with point X (see FIG. 5). Connector 46 at the lower end thereof is integrally molded to laterally extending spacer 50 in turn integrally molded to flange 52 (shaped like a finger) spaced from connector 46 by spacer 50. Channel, slot or groove 48 cuts through an edge portion of spacer 50 and flange 52 to permit lines 30 to pass between connector 46 and flange or finger 52 from reel 28 and abut spacer 50 at it is channelled by channel, slot or groove 48 from "hanger support" 20 (see FIG. 3). Therefore, as can be seen, the construction of hanger support 20 by offsetting hanger 24, channel 38 of take-up reel 28 and the L-shaped locking structure 44 in the manner described precludes "hanger support" 20 from laterally rotating about point X to one side or from tilting or rotating about point X either forwardly or rearwardly out of vertical plane when hanger support 20 is secured by lines 30 to planter 22 and secured to a support (not shown) which engages hanger 24 at point X.

To adjust the distance planter 22 is supported below hanger support 20, lines 30 need only be taken up (wound) or let out (unwound) from take-up reel 28. To secure lines 30 to take-up reel 28, lines 30 are wound together on collar 32 after passing the ends through aperture 54 (seen best in FIGS. 4 and 5) extending through surface 40 of collar 32 through the body of collar 32 opening through inner radial surface 56 and crimping, covering or knotting them.

When adjustment of planter 22 up or down relative to "hanger support" 20 is required, the line 30 is wound together around collar 32 in channel 38. The radius of the collar 32 (for example $\frac{3}{8}''$ [0.96 cm]), will control the increments of adjustments available with "hanger support" (for example, approximately $\frac{3}{4}\pi''$ or $1.92\pi$ cm adjustments for the lines at surface 40 of collar 32). If finer adjustment is required, the ends of line 30 projecting beyond inner radial surface 56 may be pulled through aperture 54 and the lines knotted or looped or clipped at 58 and the line rewound about reel 28.

To permit relative rotation about a vertical axis of hanger 24 relative to take-up reel 28, the two components may be separately molded and secured by a pin 60 fixedly imbedded in wall 36 and secured through a hole 62 passing through hanger 24 vertically aligned with point X (see FIG. 6). Because channel, slot or groove 48 is vertically aligned with point X (see FIG. 5 particularly), relative rotation of take-up reel 28 and hanger 20 is permitted without tilting of hanger 20 out of vertical or lateral rotation about point X (see FIG. 7).

"Hanger support" 20 is shown in FIG. 1 supporting receptacle 22 by the use of three lines 30 wound in take-up reel 28 and extending therefrom spread from cylindrical bead 62 to three separate places 64 proximate rim 63 at which place, each line is secured. To this end the end of each line carries an upset, enlarged end or bead, or knot or the like. Each position carries a tabulate body or protrusion 64 of the construction shown in my Canadian patent application Ser. No. 372,031. Particularly each tabulate body or protrusion 64 is disposed proximate rim 63 and has face 66 on the side of body 64 remote the outer surface 67 of planter 22. Each tabulate body or protrusion 64 carries vertically extending slot 68 intermediate body's 64 width from the top 70 of protrusion 64 and opening through the bottom and face 66, the portion of slot 68 opening through face 66 being less than the width of slot 68. Slot 68 comprises a wider slot portion or socket 72 at the upper end of slot 68 in communication with slot 68 and opening through face 66, the opening of socket 72 through the face 66 being the same as the opening of slot 68 through face 66. Slot 68 opens at the bottom into a channel, slot or groove 75 defined by element 74 extending from face 66 beyond the periphery of body 64 spaced from outer surface 67 curvilinearly around body 64 to upper rim 70 and having means for example, element 74 being thickened in places between surface 67 and element 74 (e.g. at the rim 70) to reduce the width of mount 74A leading into channel, slot or groove 75, to require flexure of each line 30 when pushed into mouth 74A past the thickened portions into channel, slot or groove 75 to thereby secure strand in channel, slot or groove 75. Therefore, when each line 30 is to be secured to each tabulate body 64, the upset knot or the like on the end of line 30 is inserted into socket 72, line 30 pushed through the opening in face 66 into slot 68 and into channel, slot or groove 75 past thickened portions 74 in mouth 74A to cause each line 30 to extend curvilinearly around body 64 and be secured in such position to support the receptacle 22.

With reference to FIGS. 8 to 11 inclusive, "hanger support" 20 is used to support another receptacle 80 which carries no visible means for its support. In this regard, three lines 30 extend from each support 20 for spreading at bead 82, to secure receptacle 80 using metal hooks 84 each carrying loop 86 on its end. Each line is fastened to base 88 on which receptacle 80 seats, base 88 comprising horizontally extending annular support 90 (reinforced by connector 92) and annular skirt 94 secured to the periphery of annular base 88 and, sloped angularly downwardly away from base 90. Three pairs of spaced apertures 96 through skirt 94 are equally spaced from one another, each pair of apertures 96 comprising apertures 96A and 96B for permitting each of lines 30 to be brought behind skirt 94, through one of apertures 96 and returned through the other aperture. On the back side 94B of skirt 94 (see FIG. 11) secured to both the underside 90B of annular support 90 and back side 94B of skirt 94B and extending between apertures 96A and 96B is curved spacer surface 98 against which line 30 abuts to prevent extreme bends in the line to prevent weakening of the line. The end of line 30 remote "hanger support" 20 is, prior to inserting through aperture 96, passed through loop 86 to hook 84, then passed through aperture 96A along surface 98 to aperture 96B, out aperture 96B and connected to loop 86 with the assistance of connector 100 by passing the line through connector 100 around a portion of loop 86 and secured in connector 100. Each hook 84 is then pulled upwardly and pulled over the rim of receptacle (planter) 80 securely supporting receptacle 80 by "hanger support" 20. Particularly the weight of receptacle 80 on base 90 causes each hook 84 to be pulled tightly onto the rim of receptacle 80 (see FIG. 8) maintaining receptacle 80 on base 90. Because three equally spaced pairs of apertures 96 have been employed for securing the three lines 30, lines 30 preclude receptacle 80 from falling from base 90 because of the disposition of the hooks 84 and supporting lines 30 at 120 degrees to one another.

With reference to FIGS. 9 and 10, each connector 100 comprises an injection molded part comprised of polycarbonate and carries slot 102 having width "w", height "h" and varying depth "d" opening through both upper end 104 and lower end 106. At each side edge of slot 102, circular slot portions 108 and 110 are of greater depth "d" than intermediate slot portion 112 between portions 108 and 110, the depth "d" of slot portion 112 being less than the thickness of line 30, however the depth "d" of portions 108 and 110 being greater than line 30. Slot portion 110 has a wider slot portion or socket 110A extending from intermediate upper and lower ends 104 and 106, to end 106 where it opens. The end of line 30 carries bell-shaped metal member 114 carrying radially directed flange 116 at one end and is secured through hole 120 in member 114 by the end of line 30 being knotted at 122 (see FIG. 10). Member 114 is wider than slot 110 but narrower than slot portion 110A and is about the length of slot portion 110A to seat in socket 110A and lock line 30 to connector 100.

Figure 12:
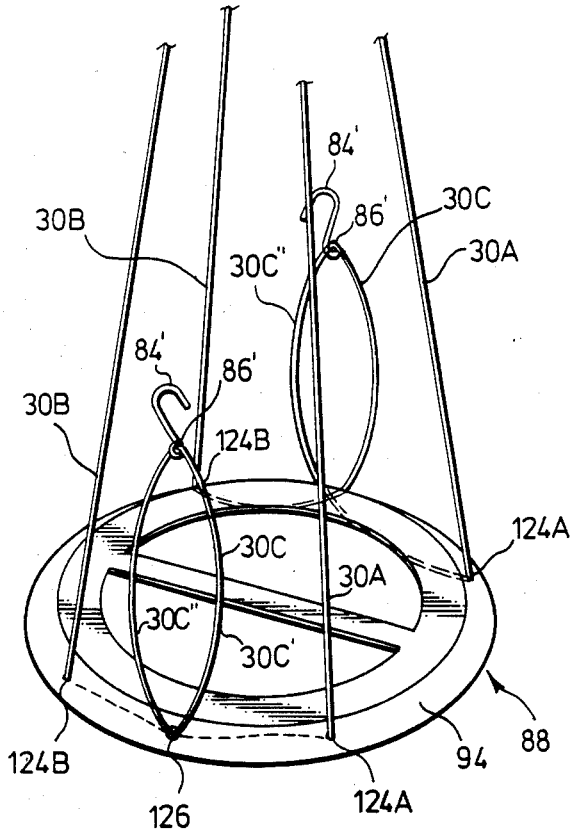
FIG. 12 is a perspective view of a support for a receptacle (for example a planter) according to still another embodiment of the invention.

With reference to FIG. 12, another method of securing planter 80 to base 88' similarly constructed to base 88 is shown which employs only two hooks and two long lines secured to one hanger support (not shown). Particularly, base 88' carries two sets of well spaced apertures 124A and 124B on skirt 94' and a third aperture 126 intermediate apertures 124A and 124B. The reason for such spacing is to ensure the end portions of line 30 extending upwardly from base 88', portion 30A and 30B, are spaced enough to hold the receptacle, along with hooks 84' secured to the rim of the receptacle (planter)—not shown, from falling from base 88'. On the under surface of skirt 94' are curved spacer surfaces (not shown) between apertures 124B and 126, and 124A and 126, against which line 30 abuts, also to prevent extreme bends in the line to prevent weakening of the line. Therefore, as is apparent, a loop 86' of material 30C carrying a hook extends through each aperture 126 with the continuation of the two ends of loop 86' extending through aperture 126 behind skirt 94' to abut the curved surfaces (not shown), with the end of loop 86' emanating from that portion between hook 84' and aperture 126 extending towards the aperture 124A or 124B remote the portion between hook 84' and aperture 126 from which it emanates. Therefore, portion 30C' closest aperture 124A (remote aperture 124B) 'crosses over' portion 30C'' and extends to aperture 124B and portion 30C'' closest aperture 124B (remote aperture 124A) 'crosses-over' portion 30C' and extends to aperture 124A, each abutting the curved surface (not shown) and, passing from behind skirt 94' through the respective aperture vertically to the support.

Therefore, any planter carried on base 88' is fully supported so that it cannot fall out when hooks 84' are applied to the planter's rim and prevented from falling by the loops of material 30C and hooks 84' and the widely spaced vertically extending portions 30A and 30B.

As many changes can be made to the embodiments without departing from the scope of the invention, it is intended that all matter contained herein be interpreted as illustrative of the invention and not in a limiting sense.

The embodiments of the invention in which a specific property or privilege is claimed are as follows:

1. For use to support a receptacle, planter or other item having an upper rim and bottom; means for supporting the receptacle, planter or other item are provided comprising a base, a plurality of strands of material, each strand passing through at least two apertures in the base at least one end of which extends to a support, each strand carrying a connector for seating over the rim of the receptacle, wherein the connector carries a depending loop to which one end of the strand is secured and through which loop the strand of material passes to the support used for suspending the receptacle, wherein said connector when fastened over the rim of the receptacle will not harm the surfaces of the receptacle.

2. The supporting means of claim 1, wherein connector is a hook carrying a depending loop to which one end of the strand is secured and through which loop the strand of material passes to the support used for suspending the receptacle.

3. The supporting means of claim 1, wherein the means for supporting the receptacle, planter or item comprises at least three strands of material, the base comprises at least three pairs of equally spaced apertures in the base, one pair for each strand, each pair of apertures being spaced from one another by a curved spacer surface on the side of the base remote the top of the base supporting the planter, for carrying one strand of material between the apertures to prevent extreme bends in the strand material to prevent weakening of the line, each strand being secured to a connector, to a loop at one end of the connector with an intermediate portion of the strand material also passing through the loop intermediate the strand's length, the other end of the strand to which the intermediate portion is secured being secured to a support to support the receptacle, planter or item.

4. The support means of claim 2, wherein the means for supporting the receptacle, planter or item comprises at least three strands of material, the base comprises at least three pairs of equally spaced apertures in the base, one pair for each strand, each pair of apertures being spaced from one another by a curved spacer surface on the side of the base remote the top of the base supporting the planter, for carrying one strand of material between the apertures to prevent extreme bends in the strand material to prevent weakening of the line, each strand being secured to a connector, to a loop at one end of the connector with an intermediate portion of the strand material also passing through the loop intermediate the strand's length, the other end of the strand to which the intermediate portion is secured being secured to a support to support the receptacle, planter or item.

5. The support means of claim 3, wherein an injection molded component is employed comprising a slot extending through a body, the slot having a width, height and varying depth, the body having an upper end and lower end, the slot extending between the upper and lower ends, each side edge of the slot being of greater depth than a central portion, the deeper slot portion on one side extending through the body from the upper end to lower end and the other deeper slot portion having an enlarged slot portion extending from intermediate the upper and lower ends to either the upper and lower ends to form a socket, the strand of material which carries the connector being locked by this component to the connector, the strand of a width to pass through the wider slot portion at each side edge of the slot but not the central reduced slot portion, the enlarged slot portion forming the socket to accommodate a fitting, button knot, rivet or the like at the end of the strand.

6. The support means of claim 4, wherein an injection molded component is employed comprising a slot extending through a body, the slot having a width, height and varying depth, the body having an upper end and lower end, the slot extending between the upper and lower ends, each side edge of the slot being of greater depth than a central portion, the deeper slot portion on one side extending through the body from the upper end to lower end and the other deeper slot portion having an enlarged slot portion extending from intermediate the upper and lower ends to either the upper and lower ends to form a socket, the strand of material which carries the hook being locked by this component to the hook, the strand of a width to pass through the wider slot portion at each side edge of the slot but not the central reduced slot portion, the enlarged slot portion forming the socket to accommodate a fitting, button knot, rivet or the like at the end of the strand.

7. The supporting means of claim 1, wherein means for supporting the receptacle, planter or other item comprises only two strands (or a plurality of strands joined together to form two strands of material) the base comprising:

(i) a pair of spaced apertures in the base, well spaced from one another and, (ii) a pair of other apertures, one of these apertures intermediate each pair of two spaced apertures in the base, each strand of material having two ends and carrying a loop of material comprised or portions of the strand of material extending through the intermediate aperture from each of the other apertures, the loop carrying a connector, each end of the loop extending through the intermediate aperture to a position behind the base to the aperture of the pair of apertures remote from the portion of the loop between the hook and intermediate aperture, the material passing through the said aperture and through the base to the support for supporting the base, the connector for attaching to the rim of the receptacle carried on the base and the ends of the material for securing the receptacle as supported by the base to a support for suspending the structure.

8. The supporting means of claim 2, wherein means for supporting the receptacle, planter or other item comprises only two strands (or a plurality of strands joined together to form two strands of material) the base comprising:

(i) a pair of spaced apertures in the base, well spaced from one another and, (ii) a pair of other apertures, one of these apertures intermediate each pair of two spaced apertures in the base, each strain of material having two ends and carrying a loop of material comprised or portions of the strand of material extending through the intermediate aperture from each of the other apertures, the loop carrying a hook, each end of the loop extending through the intermediate aperture to a position behind the base to the aperture of the pair of apertures remote from the portion of the loop between the hook and intermediate aperture, the material passing through the said aperture and through the base to the support for supporting the base, the hook for attaching to the rim of the receptacle carried on the base and the ends of the material for securing the receptacle as supported by the base to a support for suspending the structure.

9. The supporting means of claim 1, wherein the base comprises a horizontally extending support portion and an annular skirt secured to the outer periphery of the horizontally extending support portion sloped angularly outwardly and downwardly away from the horizontally extending support portion and the apertures are disposed in the skirt.

10. The supporting means of claim 2, wherein the base comprises a horizontally extending support portion and an annular skirt secured to the outer periphery of the horizontally extending support portion sloped angularly outwardly and downwardly away from the horizontally extending support portion and the apertures are disposed in the skirt.

11. The supporting means of claim 3, wherein the base comprises a horizontally extending support portion and an annular skirt secured to the outer periphery of the horizontally extending support portion sloped angularly outwardly and downwardly away from the horizontally extending support portion and the apertures are disposed in the skirt.

12. The supporting means of claim 4, wherein the base comprises a horizontally extending support portion and an annular skirt secured to the outer periphery of the horizontally extending support portion sloped angularly outwardly and downwardly away from the horizontally extending support portion and the apertures are disposed in the skirt.

13. The supporting means of claim 5, wherein the base comprises a horizontally extending support portion and an annular skirt secured to the outer periphery of the horizontally extending support portion sloped angularly outwardly and downwardly away from the horizontally extending support portion and the apertures are disposed in the skirt.

14. The supporting means of claim 6, wherein the base comprises a horizontally extending support portion and an annular skirt secured to the outer periphery of the horizontally extending support portion sloped angularly outwardly and downwardly away from the horizontally extending support portion and the apertures are disposed in the skirt.

15. The supporting means of claim 7, wherein the base comprises a horizontally extending support portion and an annular skirt secured to the outer periphery of the horizontally extending support portion sloped angularly outwardly and downwardly away from the horizontally extending support portion and the apertures are disposed in the skirt.

16. The supporting means of claim 8, wherein the base comprises a horizontally extending support portion and an annular skirt secured to the outer periphery of the horizontally extending support portion sloped angularly outwardly and downwardly away from the horizontally extending support portion and the apertures are disposed in the skirt.

17. For use to support a receptacle, planter or other item having an upper rim and bottom; means for supporting the receptacle, planter or other item are provided comprising a base, a plurality of strands of material, each strand passing through a plurality of apertures in the base at least one end of which extends to a support, each strand carrying a connector for seating over the rim of the receptacle; wherein the connector carries a depending loop to which one end of the strand is secured and through which loop the strand of material passes to the support used for suspending the receptacle, wherein said connector when fastened over the rim of the receptacle will not harm the surfaces of the receptacle, wherein the means for supporting the receptacle, planter or item comprises at least three strands of material, the base comprises at least three pairs of equally spaced apertures in the base, one pair for each strand, each pair of apertures being spaced from one another by a curved spacer surface on the side of the base remote the top of the base supporting the planter, for carrying one strand of material between the apertures to prevent extreme bends in the strand material to prevent weakening of the line, each strand being secured to a connector, to a loop at one end of the connector with an intermediate portion of the strand material also passing through the loop intermediate the strand's length, the other end of the strand to which the intermediate portion is secured being secured to a support to support the receptacle, planter or item; wherein an injection molded component is employed comprising a slot extending through a body, the slot having a width, height and varying depth, the body having an upper end and lower end, the slot extending between the upper and lower ends, each side edge of the slot being of greater depth than a central portion, the deeper slot portion on one side extending through the body from the upper end to lower end and the other deeper slot portion having an enlarged slot portion extending from intermediate the upper and lower ends to either the upper and lower ends to form a socket, the strand of material which carries the connector being locked by this component to the connector, the strand of a width to pass through the wider slot portion at each side edge of the slot but not the central reduced slot portion, the enlarged slot portion forming the socket to accommodate a fitting, button knot, rivet or the like at the end of the strand.

18. For use to support a receptacle, planter or other item having an upper rim and bottom; means for supporting the receptacle, planter or other item are provided comprising a base, a plurality of strands of material, each strand passing through a plurality of apertures in the base at least one end of which extends to a support, each strand carrying a hook for seating over the rim of the receptacle; wherein the hook carries a depending loop to which one end of the strand is secured and through which loop the strand of material passes to the support used for suspending the receptacle, wherein said hook when fastened over the rim of the receptacle will not harm the surfaces of the receptacle, wherein the means for supporting the receptacle, planter or item comprises at least three strands of material, the base comprises at least three pairs of equally spaced apertures in the base, one pair for each strand, each pair of apertures being spaced from one another by a curved spacer surface on the side of the base remote the top of the base supporting the planter, for carrying one strand of material between the apertures to prevent extreme bends in the strand material to prevent weakening of the line, each strand being secure to a hook, to a loop at one end of the hook with an intermediate portion of the strand material also passing through the loop intermediate the strand's length, the other end of the strand to which the intermediate portion is secured being secured to a support to support the receptacle, planter or item; wherein an injection molded component is employed comprising a slot extending through a body, the slot having a width, height and varying depth, the body having an upper end and lower end, the slot extending between the upper and lower ends, each side edge of the slot being of greater depth than a central portion, the deeper slot portion on one side extending through the body from the upper end to lower end and the other deeper slot portion having an enlarged slot portion extending from intermediate the upper and lower ends to either the upper and lower ends to form a socket, the strand of material which carries the hook being locked by this component to the hook, the strand of a width to pass through the wider slot portion at each side edge of the slot but not the central reduced slot portion, the enlarged slot portion forming the socket to accommodate a fitting, button knot, rivet or the like at the end of the strand.

19. The supporting means of claim 17, wherein the base comprises a horizontally extending support portion and an annular skirt secured to the outer periphery of the horizontally extending support portion sloped angularly outwardly and downwardly away from the horizontally extending support portion and the apertures are disposed in the skirt.

20. The supporting means of claim 18, wherein the base comprises a horizontally extending support portion and an annular skirt secured to the outer periphery of the horizontally extending support portion sloped angularly outwardly and downwardly away from the horizontally extending support portion and the apertures are disposed in the skirt.

* * * * *

UNITED STATES PATENT AND TRADEMARK OFFICE

CERTIFICATE OF CORRECTION

PATENT NO. : 4,669,693

DATED : June 2, 1987

INVENTOR(S) : Michael Kagan

It is certified that error appears in the above-identified patent and that said Letters Patent is hereby corrected as shown below:

In the Abstract at line 7 after 'carrying', the following phrase is inserted ---a connector for seating over the rim of the receptacle, wherein the connector carries a depending loop to which one end of the strand is secured and through which loop the strand of material passed to the support used for suspending the receptacle, wherein said connector when fastened over the rim of the receptacle will not harm the surfaces of the receptacle.--- and the phrase "a hook or other inert or non-effacing connector for seating over the rim of the receptacle." has been deleted;

Signed and Sealed this

Twenty-fourth Day of November, 1987

*Attest:*

DONALD J. QUIGG

*Attesting Officer*

*Commissioner of Patents and Trademarks*